US005618168A

United States Patent [19]

Moon

[11] Patent Number: 5,618,168

[45] Date of Patent: Apr. 8, 1997

[54] CIRCULATING PUMP

[75] Inventor: Sung-Dai Moon, Kyeongsangbook-Do, Rep. of Korea

[73] Assignee: Daewoo Electronics Co., Ltd., Seoul, Rep. of Korea

[21] Appl. No.: 582,172

[22] Filed: Jan. 2, 1996

[30] Foreign Application Priority Data

Jun. 29, 1995 [KR] Rep. of Korea ..... 95-18229

[51] Int. Cl.[6] ..... F04D 29/08

[52] U.S. Cl. ..... 417/423.11; 415/170.1; 415/171.1

[58] Field of Search ..... 417/423.11, 423.14; 415/171.1, 109, 170.1

[56] References Cited

U.S. PATENT DOCUMENTS

| | | | |
|---|---|---|---|
| 2,911,918 | 11/1959 | Reed | 417/423.11 X |
| 3,478,689 | 1/1969 | Ball | 417/423.11 X |
| 4,321,009 | 3/1982 | Fuji et al. | 415/170.1 |
| 5,156,535 | 10/1992 | Budris et al. | 417/423.11 X |
| 5,209,635 | 5/1993 | Stewart et al. | 415/170.1 X |

*Primary Examiner*—Richard E. Gluck

*Attorney, Agent, or Firm*—Beveridge, DeGrandi, Weilacher & Young LLP

[57] ABSTRACT

The present invention relating to a circulating pump for pressurizing and circulating fluid in a system such as a boiler has an object to provide a circulating pump having an improved shroud of an impeller and suction ring of a pump housing to thereby reduce power loss in a motor and leakage of high pressurized fluid. The circulating pump according to the present invention comprises a motor, an impeller and a pump housing. A motor shaft is supported rotatably and slidably in an axial direction of the motor shaft by a lower bush bearing and an upper bush bearing. A plurality of grooves are symmetrically formed on an annular flange about the center thereof. Each of the grooves is arranged along the theoretical streamline of a vortex flow which is made from the central end toward the outside of the annular flange under the action of centrifugal force occurring according to the rotation thereof. By the plural grooves, fluid that has flowed into the impeller through a clearance between the shroud and the suction ring is pressed outwardly.

4 Claims, 6 Drawing Sheets

CIRCULATING PUMP

BACKGROUND OF THE INVENTION

1. Field of the Invention

The present invention relates to a circulating pump for pressurizing and circulating fluid in a system such as a boiler, and more particularly to a circulating pump having an improved shroud of an impeller and suction ring of a pump housing to thereby reduce power loss in a motor and leakage of pressurized fluid in a pump.

2. Description of the Prior Art

In general, a circulating pump is equipped in a system such as a boiler for circulating fluid under the action of pressure. Such a circulating pump conventionally comprises a motor acting as a power source for the circulating pump; an impeller which is combined with an output shaft of the motor, rotates together with the motor shaft according to the rotation of the motor shaft, and directly pressurizes fluid; and a pump housing which receives the impeller and includes an inlet passage for allowing fluid to flow into the impeller and an outlet passage for allowing fluid pressurized by the impeller to flow out of the impeller.

In such a prior-art circulating pump, fluid that has flowed into the pump housing through the inlet passage of the pump housing is pressurized by the impeller rotating according to the driving of the motor and flows out of the pump housing through the outlet passage thereof.

FIG. 1 and FIG. 2 show an embodiment for the prior-art circulating pump as described above.

According to FIG. 1 and FIG. 2, a prior-art circulating pump 1 comprises a motor 10, an impeller 20 and a pump housing 30.

Motor 10 includes a stator 11, a rotor 12 and a motor shaft 13. Stator 11 is fixed inside a motor housing 14. Rotor 12 is fixedly assembled with motor shaft 13 and separated from stator 11 by a stator can 15. One end of motor shaft 13 is supported by a lower bearing holder **16*a* and a lower bush bearing 17*a* at the inner bottom of motor housing 14. The other end of motor shaft 13 passes through a motor end shield 18 and is supported by an upper bearing holder 16*b* and an upper bush bearing 17*b* at motor end shield 18. Motor shaft 13 is supported by a trust bearing 17*c* which is to keep motor shaft 13 from rising in an axial direction of motor shaft 13. Between lower bearing holder 16*a* and stator can 15, an O-ring 19*a* is provided to prevent fluid from leaking out. Likewise, an O-ring 19*b* prohibits the leakage of fluid between motor end shield 18 and stator can 15**.

Impeller 20 includes an impeller body 21 and a shroud 22. Impeller body 21 and shroud 22 are, in general, connected to each other by an ultrasonic welding. Impeller body 21 is tightly fitted at the other end of motor shaft 13 by a bush 23. At the center of shroud 22 a through hole 24 is formed.

A pump housing 30 is disposed onto motor 10. Pump housing 30 includes an inlet passage 31 and an outlet passage 32 at its right and left sides respectively and an impeller chamber 33 at the center thereof. Impeller 20 is disposed inside impeller chamber 33. A suction ring 34 with a flange **34*a* and a cylinder 34*b* is provided at one end of inlet passage 31 of pump housing 30 just above shroud 22 of impeller 20. A fluid guide hole 35 is formed at the center of suction ring 34. Cylinder 34*b* of suction ring 34 protrudes with a predetermined length into through hole 24 formed at the center Of shroud 22 of impeller 20. Between through hole 24 of shroud 22 and an outer wall of cylinder 34*b* of suction ring 34, and between an upper end of shroud 22 and a lower side of flange 34*a* of suction ring 34, some measure of clearance is provided. An O-ring 19*c* is provided to prevent fluid from leaking out between pump housing 30 and motor end shield 18**.

According to the prior-art circulating pump constructed as above, when an electric current is applied to stator 11 of motor 10, motor shaft 13 which is rotatably supported against motor housing 14 by means of lower bush bearing **17*a* and upper bush bearing 17*b* rotates by an electromagnetic force occurring between stator 11 and rotor 12. Accordingly, impeller 20 which is tightly fitted at one end of motor shaft 13 by means of bush 23 rotates. When impeller 20 rotates, the fluid that has flowed into impeller 20 through inlet passage 31 and suction ring 34 of pump housing 30 is pressurized by impeller 20 and is delivered into impeller chamber 33 and subsequently to outlet passage 32. At this time, some of the pressurized fluid in impeller chamber 33 flows into stator can 15 through a gap between motor shaft 13 and upper bush bearing 17*b*. The fluid that has flowed into stator can 15 cools motor 10**.

However, according to the prior-art circulating pump constructed as above, when circulating pump 1 operates, fluid pressure in impeller chamber 33 is higher than that in an inside of impeller 20, thus impeller 20 is forced toward suction ring 34. However, since motor shaft 13 fixed at impeller 20 is supported by trust bearing **17*c* which is to keep the motor shaft 13 from rising in the axial direction, impeller 20 rotates against the force affecting suction ring 34 and therefore some of rotating power of motor 10** is consumed in overcoming resistance due to the pressure difference. It is a problem in that such a power loss results in a pump efficiency to decline.

Also according to the prior-art circulating pump constructed as above, since fluid pressure in impeller chamber 33 is higher than that in the inside of impeller 20, when circulating pump 1 operates, pressurized fluid that has flowed into impeller chamber 33 leaks out to inlet passage 31 through the clearance between an upper end of shroud 22 and a lower side of flange **34*a* of suction ring 34 and between through hole 24 of shroud 22 and an outer wall of cylinder 34*b* of suction ring 34. Such leakage of pressurized fluid reduces the the efficiency of the circulating pump 1**.

In addition, according to the prior-art circulating pump constructed as above, when circulating pump 1 operates, impeller 20 is forced toward suction ring 34. However, if the upper end of shroud 22 were brought into contact with the lower side of flange **34*a*, the circulating pump 1 might be critically damaged; therefore motor shaft 13 is supported by trust bearing 17*c* so as not to move up along the axis of motor shaft 13. Due to the existence of trust bearing 17*c*, the number of parts increases, accordingly the manufacturing process and the structure of pump 1** are complicated and the manufacturing cost is high.

SUMMARY OF THE INVENTION

It is an object of the present invention to provide a circulating pump which overcomes the deficiencies of the prior art. The present invention is intended to reduce loss of power of the motor, avoid leakage of pressurized fluid, and eliminate the need for a trust bearing so that a high degree of pump efficiency, a simple structure and a cost-effective manufacturing process can be obtained.

This object is achieved by providing a circulating pump comprising a motor, an impeller, and a pump housing wherein: the motor includes a motor housing, a stator fixed inside the motor housing, a stator can, a motor end shield and a plurality of sealing members for separating the stator from fluid, a rotor rotating by means of an electromagnetic interaction with the stator when an electric current is applied to the stator, and a motor shaft integrally combined with the rotor. One end of the motor shaft is supported rotatably and slidably in an axial direction of the motor shaft by a lower bush bearing at the inner bottom of the motor housing, and, the other end of the motor shaft is projected passing through a through hole formed in the motor end shield. The motor shaft is supported rotatably and slidably in the axial direction by an upper bush bearing at the through hole of the motor end shield. The impeller includes an impeller body having a plurality of blades for pressurizing fluid and is fixedly assembled with the other end of the motor shaft and a shroud integrally fixed onto the impeller body. At the center of the shroud a through hole is formed for allowing fluid to flow, at the upper side of the shroud an annular flange is formed, and on the annular flange of the shroud a plurality of grooves is formed. The pump housing includes a housing body disposed onto the motor and comprises an inlet passage and an outlet passage provided at both sides of the pump housing respectively, at the center of the housing body the impeller is disposed and an impeller chamber is communicated with the inlet passage and the outlet passage. A suction ring is combined at an inner end of the inlet passage of the housing body for guiding fluid through the inlet passage into the impeller.

Preferably, a plurality of grooves are symmetrically arranged on the annular flange about the center thereof and each of the grooves is formed along the theoretical streamline of a vortex flow which is made from the central end toward the outside of the annular flange under the action of centrifugal force occurring according to the rotation thereof. The suction ring is preferably composed of a flange and an inclined guide portion and at an upper edge of the through hole, an inclined surface with the same angle as the inclined guide portion is preferably provided.

In the circulating pump constructed according to the present invention, when the impeller rotates, the fluid pressure in the impeller chamber is higher than that in an inside of the impeller. By the pressure difference, the impeller moves to rise toward the suction ring while rotating. Fluid that has flowed into a clearance between the impeller and the suction ring due to the pressure difference is affected by a centrifugal force going back toward an outside of the annular flange by a plurality of grooves thereon. This fluid conflicts with the pressurized fluid to thereby form a fluid film with a considerable pressure between the shroud and the suction ring. The fluid film acts as a fluid bearing for supporting the impeller so that the impeller can rotate lubricatively without contacting the suction ring.

Therefore, according to the present invention, since the impeller is supported by means of the fluid bearing which is performed by the fluid film formed between the shroud and the suction ring, it is possible to reduce the motor power consumed for overcoming the resistance which is caused by the pressure difference between the impeller chamber and the inside of the impeller. Also, since the pressure difference causing the leakage of fluid is offset to some extent by the centrifugal force which is given to the fluid that has flowed into the clearance between an upper side of the annular flange and a lower side of the flange, this will prevent leakage of pressurized fluid that would let a pump efficiency of the circulating pump fall. Also, since the impeller is supported by the fluid film formed between the shroud and the suction ring, any additional part for repressing the axial upward movement of the impeller such as a trust bearing is not required, accordingly a circulating pump having a simple structure and a cost-effective manufacturing process can be obtained.

BRIEF DESCRIPTION OF THE DRAWINGS

The object and merits of the present invention will now be clarified by way of example with reference to the accompanying drawings in which.

DETAILED DESCRIPTION OF THE PREFERRED EMBODIMENT

Figure 1:
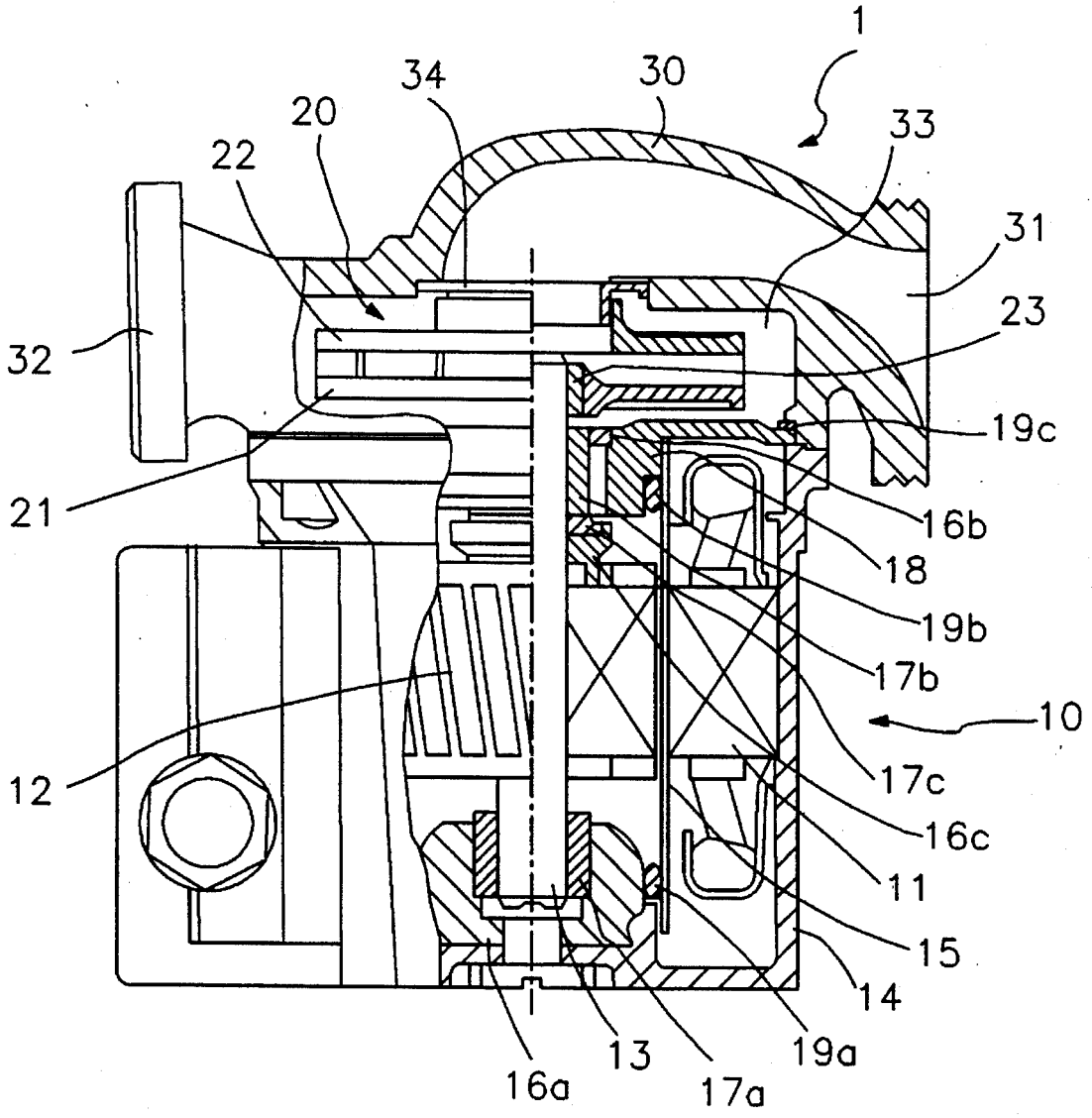
FIG. 1 PRIOR ART
FIG. 1 is a front view, partly in section, of a prior-art circulating pump.
Figure 2:
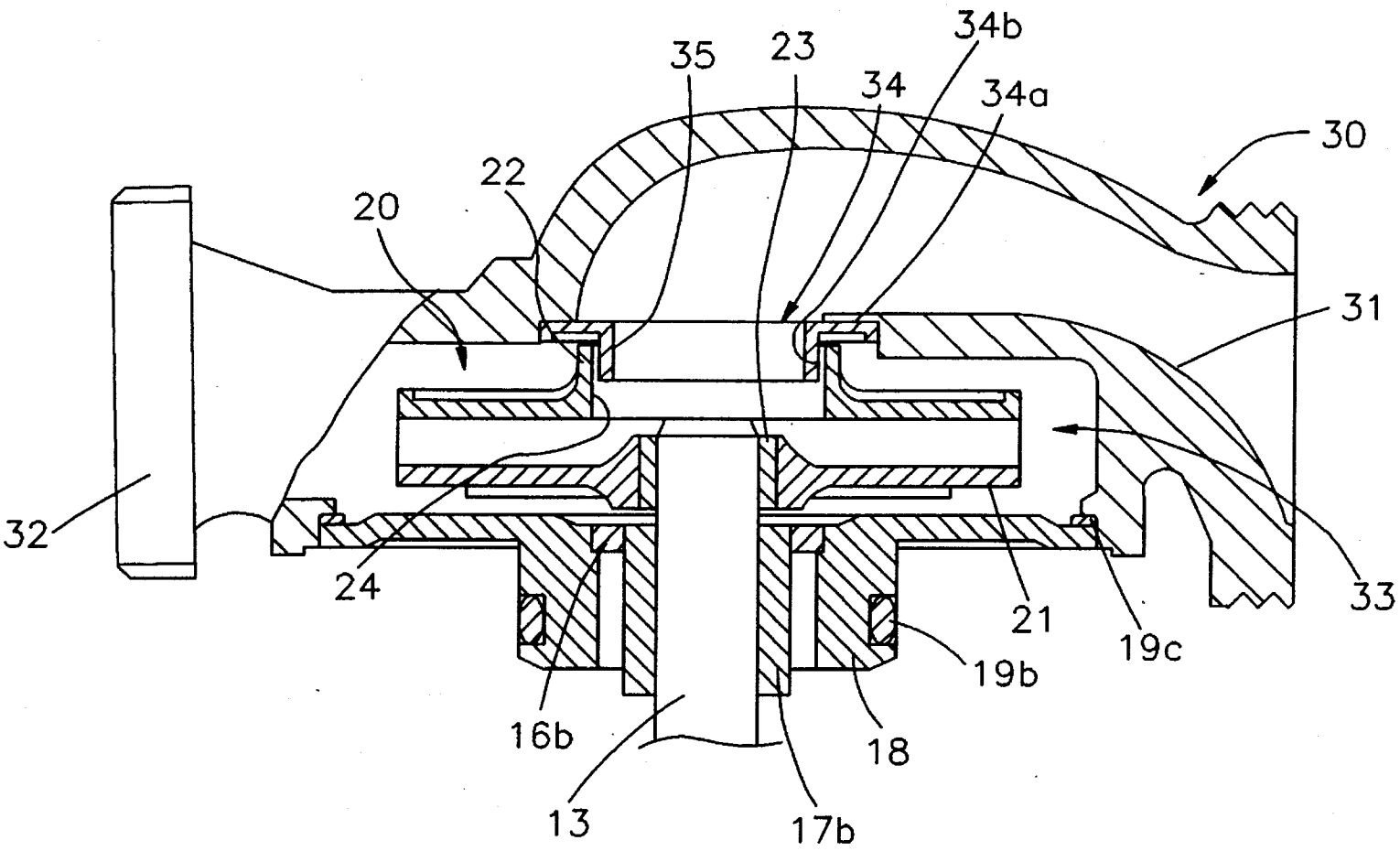
FIG. 2 PRIOR ART
FIG. 2 is an enlarged view for showing the dispositional relationship of an impeller and a pump housing as shown in FIG. 1.
Figure 3:
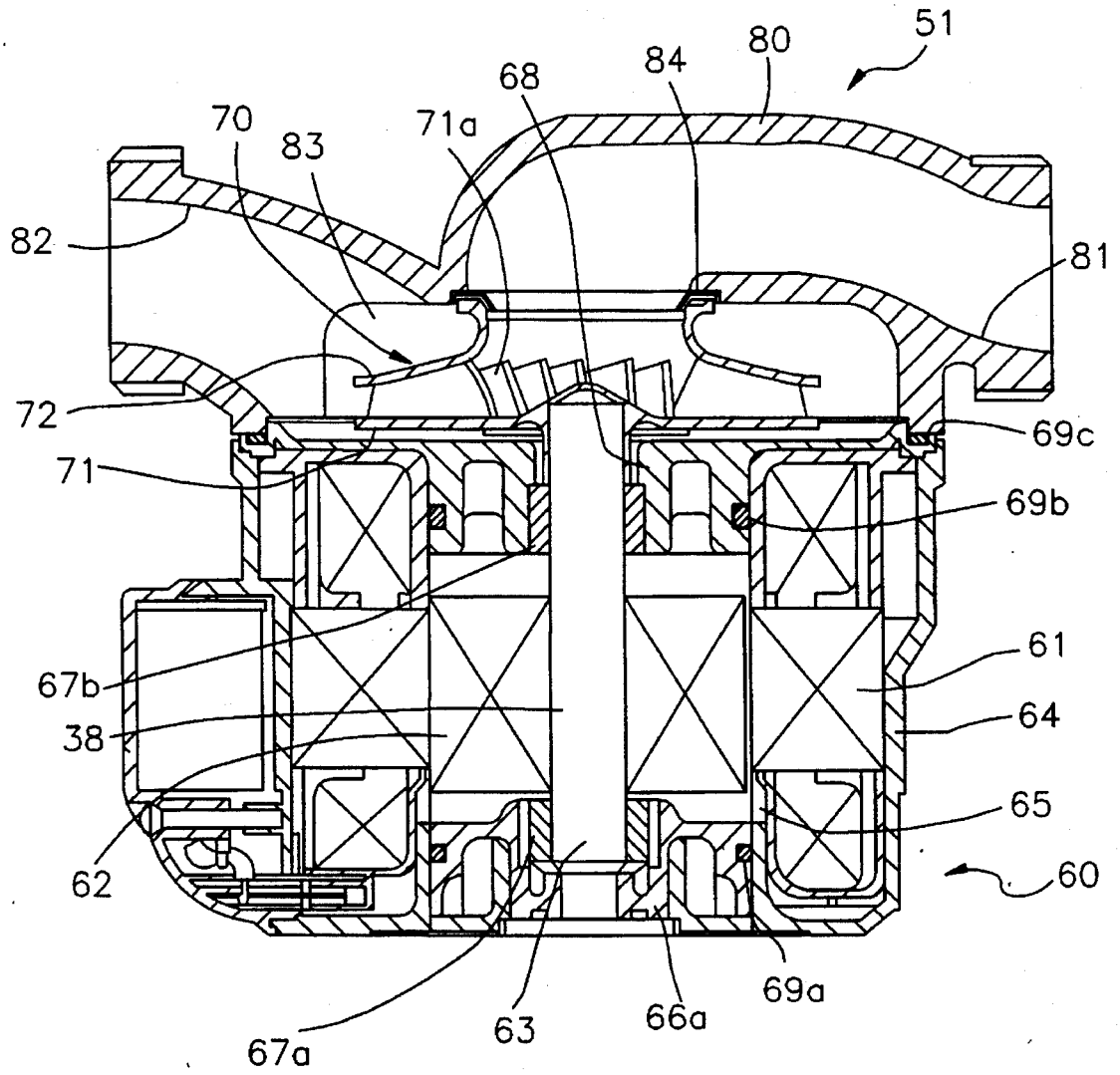
FIG. 3 is a cross-sectional view for showing a circulating pump according to the present invention.
Figure 4:
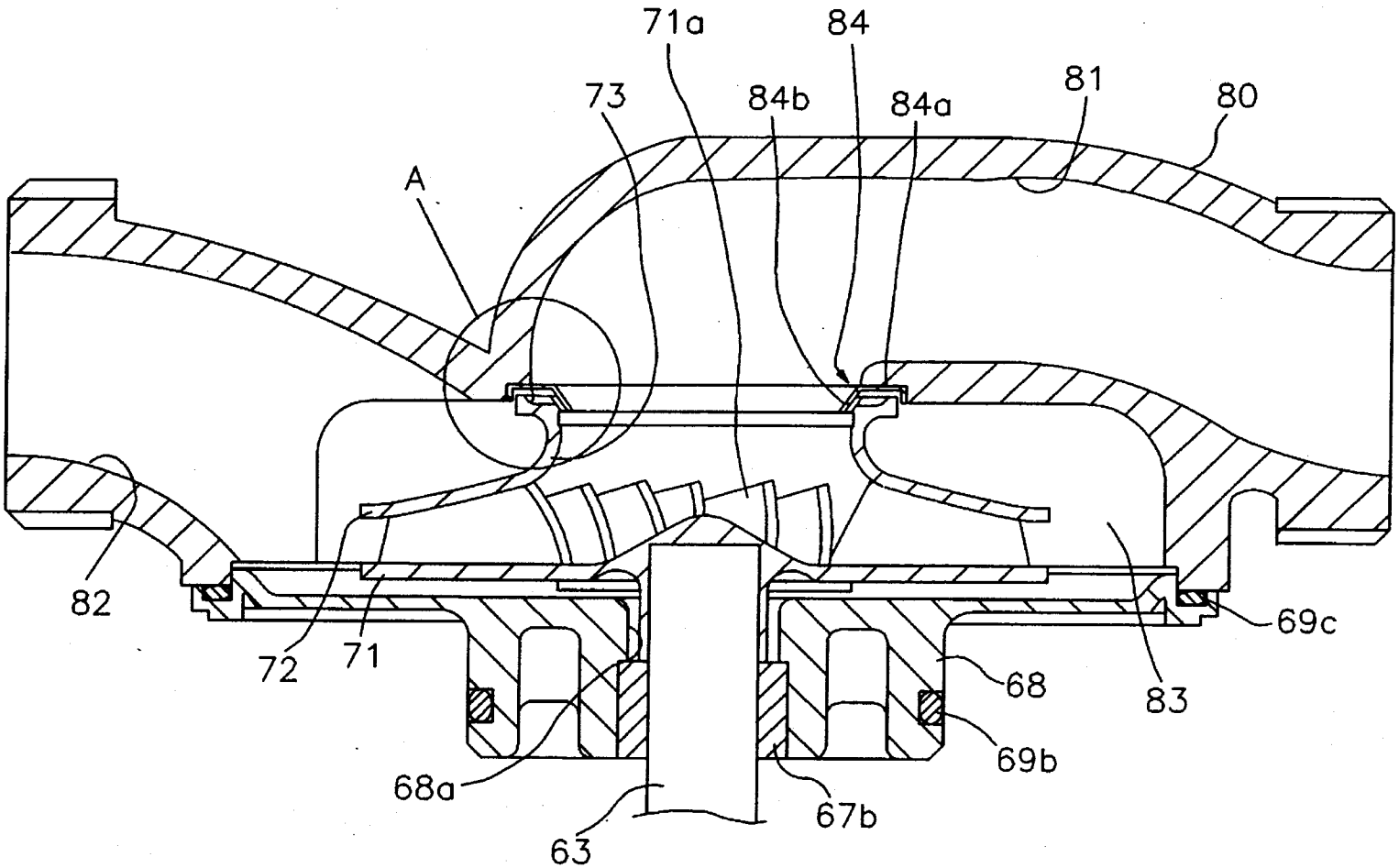
FIG. 4 is an enlarged view for showing the dispositional relationship of an impeller and a pump housing as shown in FIG. 3.
Figure 5:
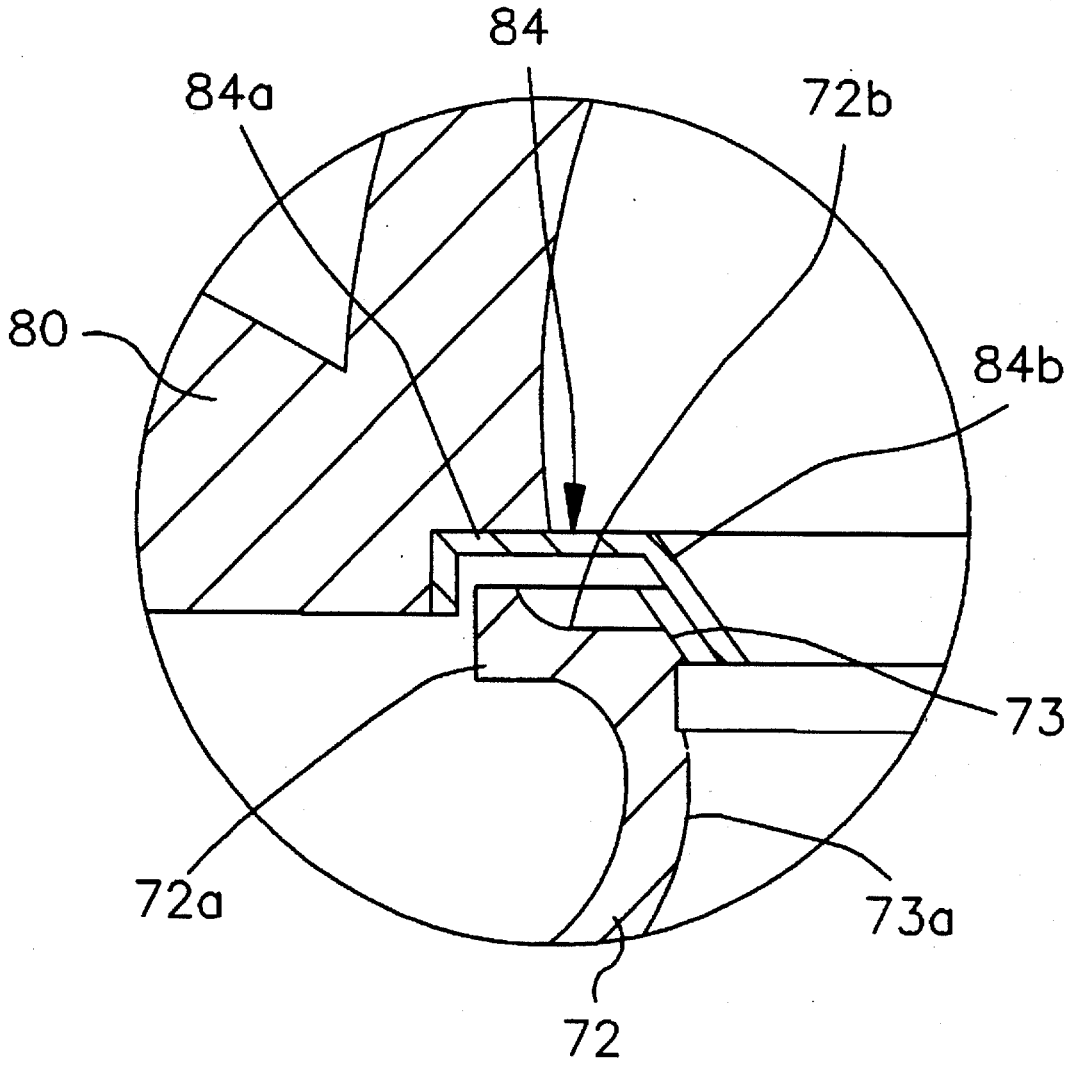
FIG. 5 is an enlarged view of a portion of "A" in FIG. 4.
Figure 6:
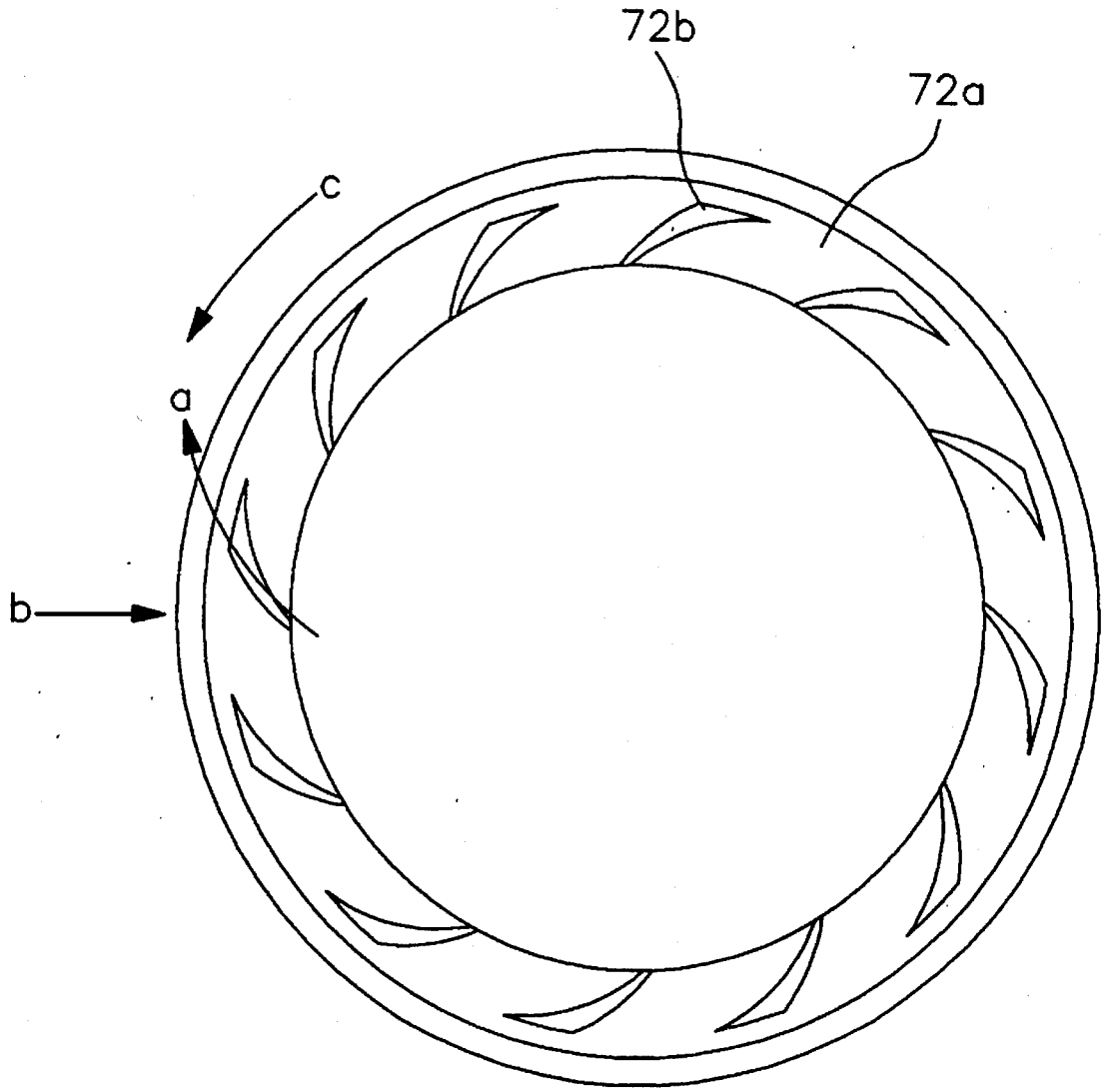
FIG. 6 is a view for showing the dispositional relationship of a plurality of grooves which are formed on an annular flange of a shroud of an impeller in a circulating pump according to the present invention.

FIG. 3–FIG. 6 illustrate an embodiment for a circulating pump according to the present invention.

In accordance with FIG. 3–FIG. 6, a circulating pump 51 comprises a motor 60, an impeller 70 and a pump housing 80.

Motor 60 includes a motor housing 64. A stator 61 is fixed inside the motor housing. Stator 61 is separated from fluid by a stator can 65, a motor end shield 68 and a plurality of sealing members 69*a*, 69*b* and 69*c*. A rotor 62 is fixedly assembled with a motor shaft 63. One end of motor shaft 63 is supported rotatably and slidably in an axial direction of motor shaft 63 by a lower bearing holder 66*a* and a lower bush bearing 67*a* at the inner bottom of a motor housing 64. The other end of motor shaft 63 passes through a through hole 68*a* formed at a motor end shield 68 and is supported rotatably and slidably in the axial direction by an upper bush bearing 67*b* at motor end shield 68. Between lower bearing holder 66*a* and stator can 65, sealing member 69*a* prohibits fluid from leaking out. Likewise, sealing member 69*b* prohibits fluid from leaking out between motor end shield 68 and stator can 65.

Impeller 70 includes an impeller body 71 and a shroud 72. Impeller body 71 and shroud 72 are connected to each other by an ultrasonic welding. Impeller body 71 has a plurality of blades 71*a* for pressurizing fluid and is fixedly assembled with the other end of motor shaft 63. Shroud 72 is integrally fixed onto impeller body 71, at the center of shroud 72 a through hole 73 is provided for allowing fluid to flow and at an upper side of shroud 72 an annular flange 72*a* is formed. A plurality of grooves 72*b* are provided on annular flange 72*a*. A plurality of grooves 72*b* are symmetrically arranged on annular flange 72*a* about a center of annular flange 72*a*. Each of grooves 72*b* is arranged along the theoretical streamline of a vortex flow which is made from the central end toward the outside of annular flange 72*a* under the action of centrifugal force occurring according to a rotation of annular flange 72*a*.

Pump housing 80 is disposed onto motor 60. Pump housing 80 includes an inlet passage 81 and an outlet passage 82 provided at both sides thereof respectively and an impeller chamber 83 at the center thereof. Impeller 70 is disposed inside impeller chamber 83. Impeller chamber 83 is communicated with inlet passage 81 and outlet passage 82 respectively. A suction ring 84 is provided at one end of impeller chamber 83. Suction ring 84 includes a flange 84*a* and an inclined guiding portion 84*b* with the same angle with the inclined surface 73*a* of shroud 72. Between pump housing 80 and motor end shield 68, sealing member 69*c* is provided to prevent fluid from leaking out.

According to the circulating pump according to the present invention constructed as above, when a current is applied to stator 61 of motor 60, motor shaft 63 which is rotatably supported against motor housing 64 by means of lower bush bearing 67*a* and upper bush bearing 67*b* rotates by an electromagnetic force occurring between stator 61 and rotor 62. Accordingly, impeller 70 which is tightly fitted at one end of motor shaft 63 rotates. When impeller 70 rotates, fluid flows into impeller 70 through inlet passage 81 and suction ring 84 of pump housing 80. The fluid is pressurized by impeller 70 and is delivered into impeller chamber 83 and subsequently to outlet passage 82. At this time, some of the pressurized fluid in impeller chamber 83 flows into stator can 65 through a gap between motor shaft 63 and upper bush bearing 67*b*. The fluid that has flowed into stator can 65 cools motor 60.

When impeller 70 rotates, fluid in an inside of impeller 70 is pressurized into impeller chamber 83 by a plurality of blades 71*a* of impeller 70. Accordingly, fluid pressure in impeller chamber 83 is higher than that in the inside of impeller 70. Accordingly, impeller 70 is forced toward suction ring 84. Meanwhile, since motor shaft 63 at which impeller 70 is fixed is supported against motor housing 64 rotatably and slidably in the axial direction by lower bush bearing 67*a* and upper bush bearing 67*b*, impeller 70 axially rises toward suction ring 84 while rotating.

Further, since the fluid pressure in impeller chamber 83 is higher than that in the inside of impeller 70, the pressurized fluid in impeller chamber 83 leaks out to inlet passage 81 through the clearance between the upper side of annular flange 72*a* of shroud 72 and the lower side of flange 84*a* of suction ring 84 and between inclined surface 73*a* of shroud 22 and inclined guiding portion 84*b* of suction ring 84.

At this time, the fluid that has flowed into the clearance between the upper side of annular flange 72*a* of shroud 72 and the lower side of flange 84*a* of suction ring 84 is affected by a centrifugal force going back toward the outside of annular flange 72*a* by a plurality of grooves 72*b* on annular flange 72*a*. By the centrifugal force, the pressure difference causing the leakage of fluid is considerably offset, accordingly the fluid leakage through the clearance is conspicuously reduced.

Besides, high pressure fluid and fluid pressurized outward by grooves 72*b* conflict with each other around an outer end of groove 72*b*. Thus, a fluid film with a considerable pressure is formed between shroud 72 and suction ring 84. The fluid film serves as a fluid bearing for supporting impeller 70 so that impeller 70 can rotate lubricatively without contacting suction ring 84. Also, since the fluid pressurized by grooves 72*b*, as indicated by the direction of arrow a in FIG. 6, flows slantly toward a rotating direction c of impeller 70 against a flow-in direction b of high pressure fluid, some of the fluid flowing through grooves 72b assists the fluid film to be formed between shroud 72 and suction ring 84. Also, inclined guiding portion 84*b* of suction ring 84 and inclined surface 73*a* of shroud 72 broaden an effective area on which the pressure of the fluid film works against impeller 70 so that the fluid film can serve well as the fluid bearing.

Therefore, according to the circulating pump constructed as described above, since impeller 70 which is fixedly assembled with motor shaft 63 and rotates with motor shaft 63 is supported by means of the fluid bearing which is performed by the fluid film formed between shroud 72 and suction ring 84, it is possible to reduce the motor power consumed for overcoming resistance which is caused by the pressure difference between impeller chamber 83 and inlet passage 81, and thus a lowering of the efficiency of a pump due to such a power loss can be avoided.

Also, according to the circulating pump constructed as described above, since the pressure difference causing the leakage of fluid is offset to some extent by the centrifugal force exerted to the fluid that has flowed into the clearance between an upper side of annular flange 72*a* and a lower side of flange 84*a* by a plurality of grooves 72*b*, this will avoid the leakage of pressurized fluid due to the pressure difference between impeller chamber 83 and inlet passage 81 that would lower the efficiency of a pump.

Additionally, according to the circulating pump constructed as described above, since impeller 70 which is fixedly assembled with motor shaft 63 and rotates with motor shaft 63 is supported by the fluid film formed between shroud 72 and suction ring 84 in the form of a fluid bearing, an additional part for repressing an axial upward movement of impeller 70 such as a trust bearing is not required, and thus a circulating pump having a simple structure and a cost-effective manufacturing process can be obtained.

It should be obvious to people skilled in the art that modifications can be made to the invention described above without departing from the spirit or the scope of the invention.

What is claimed is:

1. A circulating pump comprising a motor, an impeller and a pump housing wherein:

the motor includes a motor housing, a stator fixed inside the motor housing, a stator can, a motor end shield and a plurality of sealing members for separating the stator from fluid, a rotor rotating by means of an electromagnetic interaction with the stator when an electric current is applied to the stator, and a motor shaft integrally combined with the rotor, one end of the motor shaft being supported rotatably and slidably in an axial direction by a lower bush bearing at the inner bottom of the motor housing, the other end of the motor shaft passing through a through hole formed in the motor end shield, and the motor shaft being supported rotatably and slidably in the axial direction by an upper bush bearing at the through hole of the motor end shield;

the impeller includes an impeller body having a plurality of blades for pressurizing fluid and fixedly assembled with the other end of the motor shaft and a shroud integrally fixed onto the impeller body, at the center of the shroud a through hole being formed for allowing fluid to flow, at the upper side of the shroud an annular flange being formed, and on the annular flange of the shroud a plurality of grooves being formed; and the pump housing includes a housing body disposed onto the motor and comprising an inlet passage and an outlet passage provided at both sides thereof respectively, at the center of the housing body the impeller being disposed and an impeller chamber communicated with the inlet passage and the outlet passage and a suction ring combined at an inner end of the inlet passage of the housing body and guiding fluid through the inlet passage into the impeller.

2. The circulating pump as claimed in claim 1 wherein the plurality of grooves are symmetrically arranged on the annular flange about the center thereof and each of the grooves is made from the central end toward the outside of the annular flange.

3. The circulating pump as claimed in claim 1 wherein the suction ring includes a flange and an inclined guide portion and at an upper edge of the of the shroud an inclined surface with the same angle as the inclined guide portion is provided.

4. The circulating pump as claimed in claim 2 wherein the suction ring includes a flange and an inclined guide portion and at an upper edge of the through hole of the shroud an inclined surface with the same angle as the inclined guide portion is provided.

* * * * *